United States Patent [19]

Rademaker

[11] Patent Number: 4,815,934

[45] Date of Patent: Mar. 28, 1989

[54] AIR DEFLECTOR ARRANGEMENT

[75] Inventor: Johan K. Rademaker, West Olive, Mich.

[73] Assignee: Hart & Cooley, Inc., Holland, Mich.

[21] Appl. No.: 33,029

[22] Filed: Mar. 31, 1987

[51] Int. Cl.[4] ..... F04D 29/44

[52] U.S. Cl. ..... 415/191; 98/40.11

[58] Field of Search ..... 415/191, 193, 194, 208, 415/209, 218; 98/40.11, 40.1, 40.05; 416/243, DIG. 2

[56] References Cited

U.S. PATENT DOCUMENTS

| | | | |
|---|---|---|---|
| Re. 25,216 | 8/1962 | Kennedy | 98/40.11 |
| Re. 28,492 | 7/1975 | Hedrick et al. | 137/316 |
| 121,942 | 12/1871 | Hayden | 98/41.1 |
| 535,447 | 3/1895 | Hudson | 416/65 |
| 1,017,820 | 2/1912 | Svebilius | 416/200 R |
| 1,073,413 | 9/1913 | Faehrmann | 40/2 R |
| 1,119,826 | 12/1914 | Howell, Jr. | 416/243 |
| 2,396,025 | 3/1946 | Seid | 98/40.25 |
| 2,464,442 | 3/1949 | De Roo | 52/820 |
| 2,488,006 | 11/1949 | De Roo | 102/304 |
| 2,504,472 | 4/1950 | Van Alsburg et al. | 98/40.15 |
| 2,541,346 | 2/1951 | De Roo | 49/53 |
| 2,598,763 | 6/1952 | De Roo | 98/40.21 |
| 2,676,795 | 4/1954 | De Roo | 49/101 |
| 2,724,320 | 11/1955 | Tutt | 98/38.2 |
| 2,736,255 | 2/1956 | Tutt et al. | 98/40.15 |
| 2,750,865 | 6/1956 | Tutt | 98/38.2 |
| 2,780,983 | 2/1957 | De Roo et al. | 116/156 |
| 2,784,659 | 3/1957 | De Roo et al. | 98/40.2 |
| 2,796,016 | 6/1957 | De Roo | 98/40.03 |
| 2,799,215 | 7/1957 | De Roo | 98/114 |
| 2,821,898 | 2/1958 | Kennedy | 90/40.11 |
| 2,822,741 | 2/1958 | Kennedy | 90/40.11 |
| 2,833,200 | 5/1958 | Olson et al. . | |
| 2,837,990 | 6/1958 | Tutt | 98/40.13 |
| 2,837,991 | 6/1958 | De Roo | 98/40.05 |
| 2,902,919 | 9/1959 | Waalkes et al. | 98/40.04 |
| 3,034,725 | 5/1962 | Person | 236/13 |
| 3,107,597 | 10/1963 | Person | 98/40.13 |
| 3,119,320 | 1/1964 | Batchelor | 98/40.11 |
| 3,166,001 | 1/1965 | Person et al. | 98/40.11 |
| 3,185,067 | 5/1965 | Batchelor | 98/40.07 |
| 3,191,615 | 6/1965 | Edwards et al. | 137/499 |
| 3,195,441 | 7/1965 | Hedrick | 236/49 |
| 3,260,188 | 7/1966 | Person | 98/140.17 |
| 3,276,349 | 10/1966 | Person | 98/40.16 |
| 3,308,743 | 3/1967 | Waeldner et al. | 98/40.09 |
| 3,366,031 | 1/1968 | Hedrick et al. | 98/101 |
| 3,516,606 | 6/1970 | Edwards | 236/13 |
| 3,592,240 | 7/1971 | Hedrick et al. | 137/316 |
| 3,640,307 | 2/1972 | Drzala | 137/557 |
| 3,683,786 | 8/1972 | Hedrick | 98/110 |
| 3,765,316 | 10/1973 | Skoch | 98/40 D |
| 3,854,386 | 12/1974 | Hedrick | 98/40 D |
| 3,948,155 | 4/1976 | Hedrick | 98/40 D |

(List continued on next page.)

OTHER PUBLICATIONS

"Truflo Launches New Range", H & V News, Jul. 1977, vol. 20, No. 7, author unknown.

*Primary Examiner*—Robert E. Garrett
*Assistant Examiner*—John T. Kwon
*Attorney, Agent, or Firm*—Varnum, Riddering, Schmidt & Howlett

[57] ABSTRACT

An air deflector arrangement (100) is disclosed and adapted for use in ceilings and similar areas for selectively providing discrete air flow patterns in radial directions relative to the arrangement (100). The air deflector arrangement (100) comprises a perforated face (102) typically mounted in a downwardly-disposed configuration and coplanar with adjacent ceiling panels or the like. The face is latched or otherwise releasably connected to a somewhat frustum-shaped back panel (110) extending upwardly from the plane of the ceiling panels. A plurality of deflector blades (140) are pivotably secured to an eyelet fastener (160) connected at a central location on the face (102). Each of the deflector blades (140) is freely rotatable throughout a 360° range of motion relative to each of the other blades. Selective blade configurations provide an infinite number of air flow patterns. The blades (140) are of a substantially optimum shape and size so as to produce distinct radial air flow patterns, while correspondingly maintaining sufficient "open areas" so as to minimize static back pressures.

22 Claims, 8 Drawing Sheets

U.S. PATENT DOCUMENTS

| | | | |
|---|---|---|---|
| 4,188,862 | 2/1980 | Douglas, III | 90/41.1 |
| 4,258,616 | 3/1981 | Zeller et al. | 98/40 D |
| 4,366,748 | 1/1983 | Wilson et al. | 90/40.1 |
| 4,445,637 | 5/1984 | Hedrick | 236/49 |
| 4,497,241 | 2/1985 | Ohkata | 98/40.25 |
| 4,515,069 | 5/1985 | Kline et al. | 98/40 D |
| 4,535,932 | 8/1915 | Herb | 236/49 |
| 4,563,622 | 1/1986 | Deavers et al. | 415/122 A |
| 4,570,850 | 2/1986 | McDermott | 236/49 |
| 4,620,869 | 11/1986 | Goossens et al. | 90/40.1 |
| 4,625,629 | 12/1986 | Bryans | 98/40.17 |

AIR DEFLECTOR ARRANGEMENT

DESCRIPTION

TECHNICAL FIELD

The invention relates to air deflector arrangements for air conditioning, ventilation and heating systems and, more particularly, relates to deflector arrangements for selectively achieving distinct air flow patterns.

BACKGROUND ART

Historically, early heating, ventilation and other types of systems employing air flow for controlling the environment of enclosed spatial areas typically comprised one or more apertures opening into the spatial area. The apertures were, in turn, located at the terminations of ducted work connected to the ventilation or heated air source. Although the apertures would often be covered with a screen or similar perforated article, the volume and directional dispersion of air into the spatial area would be dependent primarily on the existing air currents in the ducted work and spatial area, aperture size, air pressure at the aperture and the configuration of the screen perforations. Accordingly, extremely minimal selective control of air flow could be achieved.

As centralized heating and similar environmental systems (including subsequently developed air conditioning systems) became more prevalent, particularly in residential and commercial construction, it became known to install air "registers" at the ducted work apertures. The registers would often comprise fixed "slats" or similar elements to direct the air flow into the spatial area. In addition, it also became known to provide the registers with slats or like elements connected to manually operable mechanisms for moving the slats so as to adjust the quantity of open cross-sectional area of the register, thereby controlling the air flow volume. With nearly every type of forced air environmental system heretofore developed, such volumetric air flow control mechanisms have become extremely common.

As environmental control technology has become more sophisticated, and with the rapid increase in energy costs, the art of controlling air flow at locations of air flow entry into the spatial environments to be controlled has become of substantial importance. Numerous types of assemblies have been designed for controlling environmental air flow.

For example, in Douglas III, U.S. Pat. No. 4,188,862, issued Feb. 19, 1980, an assembly primarily directed to air conditioning registers of relatively small size is disclosed. The assembly includes a housing, a louver and a "closure segment" mounting shaft. A knob fits on the end of the shaft as it protrudes through a centrally located hub. A series of closure segments are mounted on the shaft for purposes of rotation relative to each other. Each closure segment is of a substantially identical triangular shape and includes an aperture at its inner shaft-engaging end. The apertures within certain of the closure segments are of a square cross-section, and adapted to receive square bosses on the shaft. Other closure segments have apertures in their shaft-engaging ends which are circular in cross-section, with a slightly larger diameter than the central portion of the shaft. Accordingly, the shaft can rotate relative to each of certain of the closure segments.

A forwardmost closure segment includes "nibs" extending downwardly from the outer circular edge of the segment. The nibs are spaced so as to be received in slots on each side of the bottommost retention member in the register louver. Accordingly, when all the closure segments are assembled on the shaft, the forwardmost segment is secured to the register louver, thus allowing the shaft to rotate relative thereto within the aperture. In a similar manner, the rearmost closure segment is secured to the shaft by means of a boss, again so that the segment rotates with the shaft. The middle closure segments are identical and mounted for rotation relative to the shaft and relative to the forwardmost and rearwardmost closure segments.

The rearwardmost closure segment includes an elongated tab extending inwardly at an angle to a radius of the shaft axis, and at an angle to the side portion of the closure segment. The outermost portion of the tab is adjacent a first side portion of the tab and the circular edge of the tab. For purposes of interconnection, the tab is raised from the outer surface of the closure segment so as to extend forwardly to the next adjacent closure segment. Certain of the closure segments have similar corresponding tabs, and certain others o the closure segments have trapezoidally-shaped recesses. The recesses have a depth slightly greater than the forward extent of the tabs so as to receive the tabs when the segments are in their assembled relationship on the shaft.

When air flow volume is desired to be at a maximum, the closure segments are positioned so that each segment axially overlaps each of the other segments. When air flow volume is desired to be decreased, the knob can be manually rotated, thereby first causing the rearmost closure segment to also be rotated in the corresponding direction. Remaining closure segments remain stationary until the tab on the rearmost segment engages the stop surface of a recess in the next adjacent closure segment. With this configuration, the register opening is slightly less than half blocked. Further rotation of the shaft causes each of the closure segments to be rotated seriatim into various configurations as shown in the Douglas III patent. The Douglas III patent can be characterized as showing a general form of volumetric air flow control.

For several reasons, technology associated with air flow environmental systems has recently become of even greater import in the construction of commercial and industrial facilities. Energy costs have caused architects, designers and facility managers to focus attention on their environmental control systems. The increasing energy costs and relatively large size of such facilities have mandated efficiency in proper delivery and dispersion of air flow. The proper dispersion of air flow is of particular concern when such facilities are controlled from a centralized source, thus often requiring heated or otherwise conditioned air to travel a substantial distance to the spatial area under control.

In addition, federal and state laws and regulations often set forth substantive restrictive requirements with respect to environmental factors, such as air quality, temperature control and the like. Further, general public attitude now prevalent in this country demands a quality work environment. Accordingly, environmental control systems must not only exhibit efficiency, but must often provide an environment relatively free of any substantial noise, drafts or other distractions. Finally, construction costs compel not only efficiency in environmental systems, but also relatively simplistic design with respect to costs of materials, ease of assembly, etc.

In many relatively modern commercial and industrial establishments, air flow is provided through ducted work above the ceilings, with the ducted work opening into the spatial areas directly through openings in the ceilings. The conventional T-bar arrangement with insulated and removable rectangular panels is an example of a ceiling construction commonly in use.

With these types of ceiling-mounted systems, the manner in which air is dispersed or "diffused" can be of primary importance with respect to efficiency and quality of environmental control of the spatial area. In these types of systems, it is not merely the volume of air flow which is important, but also the dispersion of air in directions radially from an axis perpendicular to the face of the opening which is important. For example, a ceiling-mounted air flow opening in the center of a relatively large spatial area should preferably have an air flow pattern substantially different from that which would be optimum for ceiling-mounted openings located in corners of the spatial area.

Correspondingly, however, the requirement of providing different types of air flow control registers or similar elements dependent on the intended installation location of the same would significantly increase the complexity and costs of manufacture, ordering and installation of environmental systems. Further, many of today's commercial and industrial establishments are constructed in the form of modular office systems. Such modular systems are designed to be modified as required by the facilities manager to accommodate changes such as number of office personnel, individual office sizes, functions to be performed and the like. It would be an extreme disadvantage to require movement of ceiling-mounted air flow systems in correspondence with changes in the modular configurations.

Various types of air flow control systems for use in relatively modern commercial and industrial establishments have been developed, including systems adapted for mounting in ceilings. For example, Wilson et al, U.S. Pat. No. 4,366,748, issued Jan. 4, 1983, describes an air diffuser having a deflector comprising a series of arms extending radially outward from a central hub. The deflector arms include a "bent up" portion described as enhancing the air deflection operation. The deflector is connected to a bottom perforated wall by a connection rivet through the central portion of the deflector, and through a perforation in the bottom wall. Rubber tabs are mounted between the flat portions of each arm and the perforated bottom for purposes of reducing contact, so that the deflector does not completely cover perforations under the arms. The use of the resilient tabs is described as substantially preventing vibrations from being transferred to the bottom wall, and improving air distribution by providing a small space between the deflector and the bottom wall, thereby uncovering wall perforations under the deflectors. The deflector is adjustable solely from a horizontal pattern to a downward pattern.

Kennedy, U.S. Pat. No. Re. 25,216, issued Aug. 7, 1962, describes an air distribution outlet having a frustum-shaped section flaring outwardly to a screen portion. The smaller diameter section of the frustum-shaped portion comprises a screen having a series of perforations. One embodiment of the Kennedy distribution outlet comprises an arrangement having two sets of four elements in the form of deflector strips. The deflector portions flare outwardly from a central pivot hub, and each strip is spaced 90° apart from its two adjacent strips. The two strip configurations can be rotated relative to each other by removing a bolt having a spring lock nut threaded thereon.

Waeldner et al, U.S. Pat. No. 3,308,743, issued Mar. 14, 1967, discloses an air duct arrangement specifically including an extensible duct section adapted for use in a ceiling having a series of bulkheads. In one embodiment, the duct arrangement includes a telescopically arranged sleeve member capable of extension and retraction by an arm. The arrangement includes a first link connected at one end to the pivotable arm, with its other end connected to a valve assembly. The valve assembly includes a fixed hub having a link attached thereto. A set of movable vanes project radially from the hub toward the inner area of the sleeve member. An actuating rod is rotatably supported on the link and connected to the inner ends of the vanes so that the vanes can be rotated between open positions (in which they are aligned with the axis of the tubular duct) and closed positions, where the vanes are at right angles to the duct axis.

In summary, although a number of mechanisms have been developed for air flow control in environmental systems, none of these systems overcome all of the typical problems associated with such control systems, while correspondingly exhibiting particular advantages in the control of air flow patterns. Of primary importance, it is particularly advantageous to achieve specific air flow patterns, while correspondingly obtaining in an optimum manner as much "open area" as possible with respect to the face of the air flow control arrangement. To the extent an air flow control arrangement requires the face to be "covered," the volume of air flow will be reduced, thereby decreasing efficiency of operation. In addition, as the percentage of the control arrangement face being covered increases, the static back pressure within the ducted work behind the control arrangement will correspondingly increase. This build up of back pressure essentially "boot straps" a decrease in the efficiency of operation of forced air systems.

Furthermore, it is advantageous to achieve discrete and definite directional air flow patterns. It should be emphasized that such patterns are not obtained merely by a general diffusion of the air as it exits from the control arrangement. Many types of systems which purport to provide directional air flow merely serve to generate a random diffusion of the air into the spatial area. Still further, it is also advantageous to achieve the discrete and definite directional air flow pattern in radial directions relative to the face of the control arrangement. If desired air flow patterns cannot be achieved in radial directions, the efficiency of environmental control of the spatial area will be significantly reduced.

In addition to the foregoing, it is also a primary advantage to achieve a commonality of design for as many components of the air flow control arrangement as possible, notwithstanding that the control arrangement may be constructed in various sizes. Correspondingly, simplicity of instruction and relatively low material costs is also of primary importance. Finally, the adjustability of the control arrangement to provide as many distinct directional air flow patterns as possible, while still providing for relative ease of adjustment, is substantially significant.

SUMMARY OF THE INVENTION

In accordance with the invention, an air deflector arrangement is adapted to be mounted in a ceiling or similar area to control air flow patterns into an enclosed spatial area. The deflector arrangement includes blade means pivotably mounted within an inner area of the deflector arrangement, and the blade means include a plurality of elongated deflector blades centrally positioned rearward of a face means. Each of the deflector blades is substantially freely rotatable throughout a 360° range of motion independent of angular locations of each of the others of the deflector blades. In this manner, the deflector arrangement allows for the blades to be rotated into various configurations so as to provide discrete and definite patterns of air flow in radial directions in the enclosed area relative to the deflector arrangement.

The face means is adapted to over or otherwise separate an inner area of the deflector arrangement from the enclosed spatial area. The face means allows relatively free passage of air through the deflector arrangement into the spatial area. Housing means are connectable to the face means and positioned rearwardly of the face means. The housing means includes an air passage to allow air flow into the housing means and through the face means into the enclosed area.

Each of the deflector blades is pivotably mounted within the inner area so as to form an axis of rotation coaxial with the axis of rotation with each of the other deflector blades. Each deflector blade is elongated in shape, with a substantially planar configuration. Each blade is mounted so that the planar configuration is substantially parallel to a planar portion of the face means.

Each blade includes a central inner portion having a substantially disc-shaped circular configuration. An elongated waist portion is integral with the central portion, and includes concave-shaped lateral edges. A distal portion is provided which is integral with the waist portion and flares outwardly relative to the waist portion. The width of the waist portion is narrower than the diameter of the central portion and the width of the distal portion. The terminating ends of the distal portions are radiused so that the sides of the face means do not interfere with free rotation of the blades.

In accordance with one aspect of the invention, the planar portion of the face means is of a rectangular configuration with four sides each of approximately 24 inches in length. The perpendicular distance between the axes of rotation and the terminating ends of the distal portions is in the range of approximately 10 to 12 inches. The diameter of each of the central portions of the blades is in the range of approximately 4 to 6 inches, and the width of each waist portion is in the range of approximately 1 to 3 inches at its minimum value between concave-shaped lateral edges. Further, the width of each distal portion at its terminating ends is in the range of approximately 4 to 6 inches. In addition, the blade means includes a series of four or more deflector blades.

The deflector arrangement also includes means located at an approximate center of the planar portion of the face means to pivotably mount each cf the deflector blades. Means are provided to releasably secure the face means to the housing means so that the face means can be opened for manual adjustment of the angular positions of the deflector blades. A collar is mounted to the housing means and surrounds the air passage. In accordance with another aspect of the invention, the face means is hingedly mounted to the housing means.

BRIEF DESCRIPTION OF THE DRAWINGS

The invention will now be described with reference to the drawings, in which.

DETAILED DESCRIPTION

The principles of the invention are disclosed, by way of example, in an air deflector arrangement 100 as shown in FIGS. 1–15. The arrangement 100 is adapted for use in a ceiling or other similar area for providing air flow into an enclosed spatial area from a heating, air conditioning or similar type of ventilation system so as to provide environmental control. The deflector arrangement 100 achieves selectivity of a theoretically infinite number of separate, distinct and discrete directional air flow patterns in radial directions from the air flow output. The arrangement 100 is of an optimum nature in that it allows for selection of directional air patterns, while correspondingly maintaining a relatively high percentage of "open area" for air flow volume, lower static pressure and greater efficiency.

Figure 1:
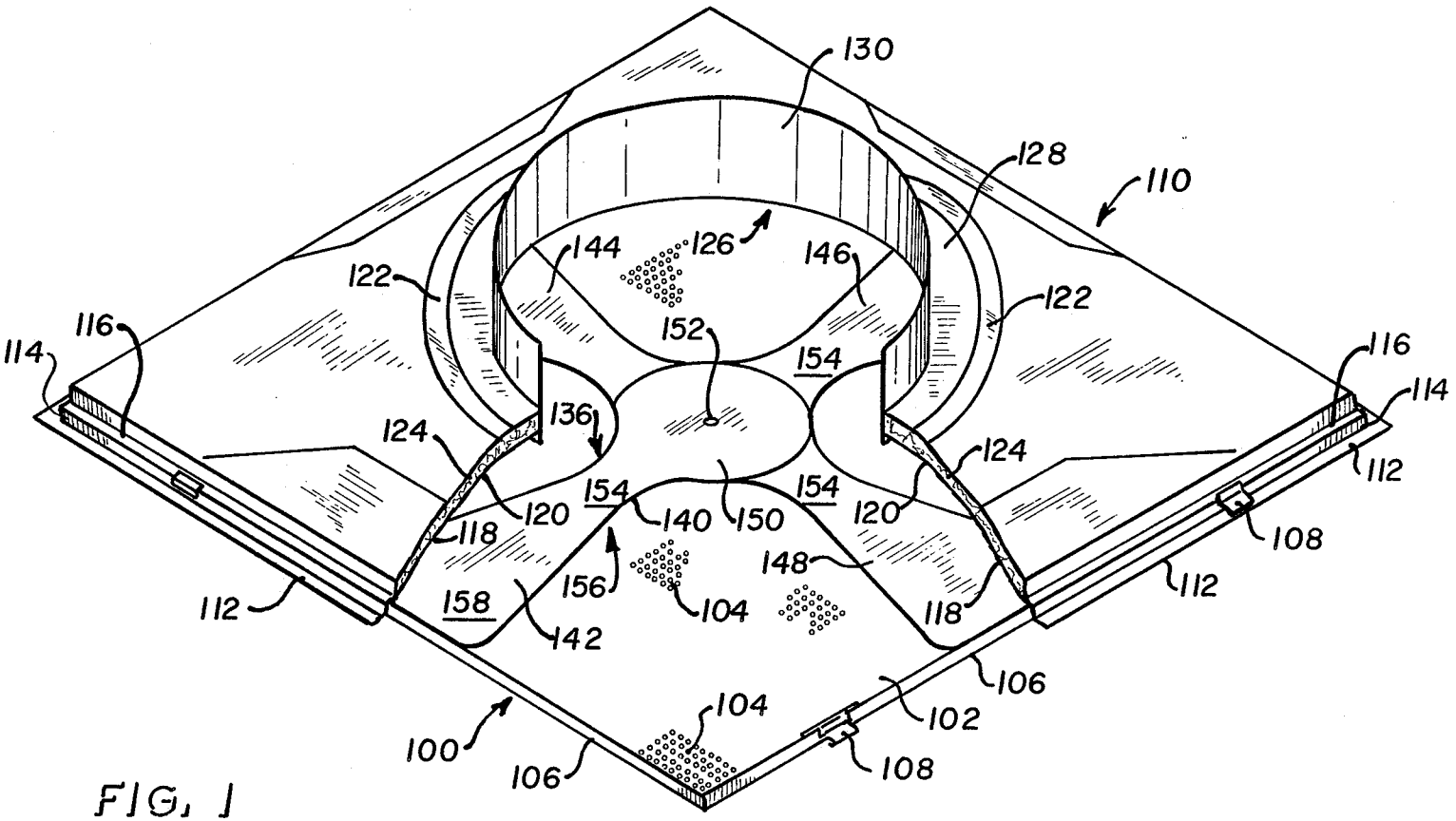
FIG. 1 is a perspective view of one illustrative embodiment of an air deflector arrangement in accordance with the invention, with a portion of the back panel and insulation cut away so as to better show a view of the deflector blades.
Figure 2:
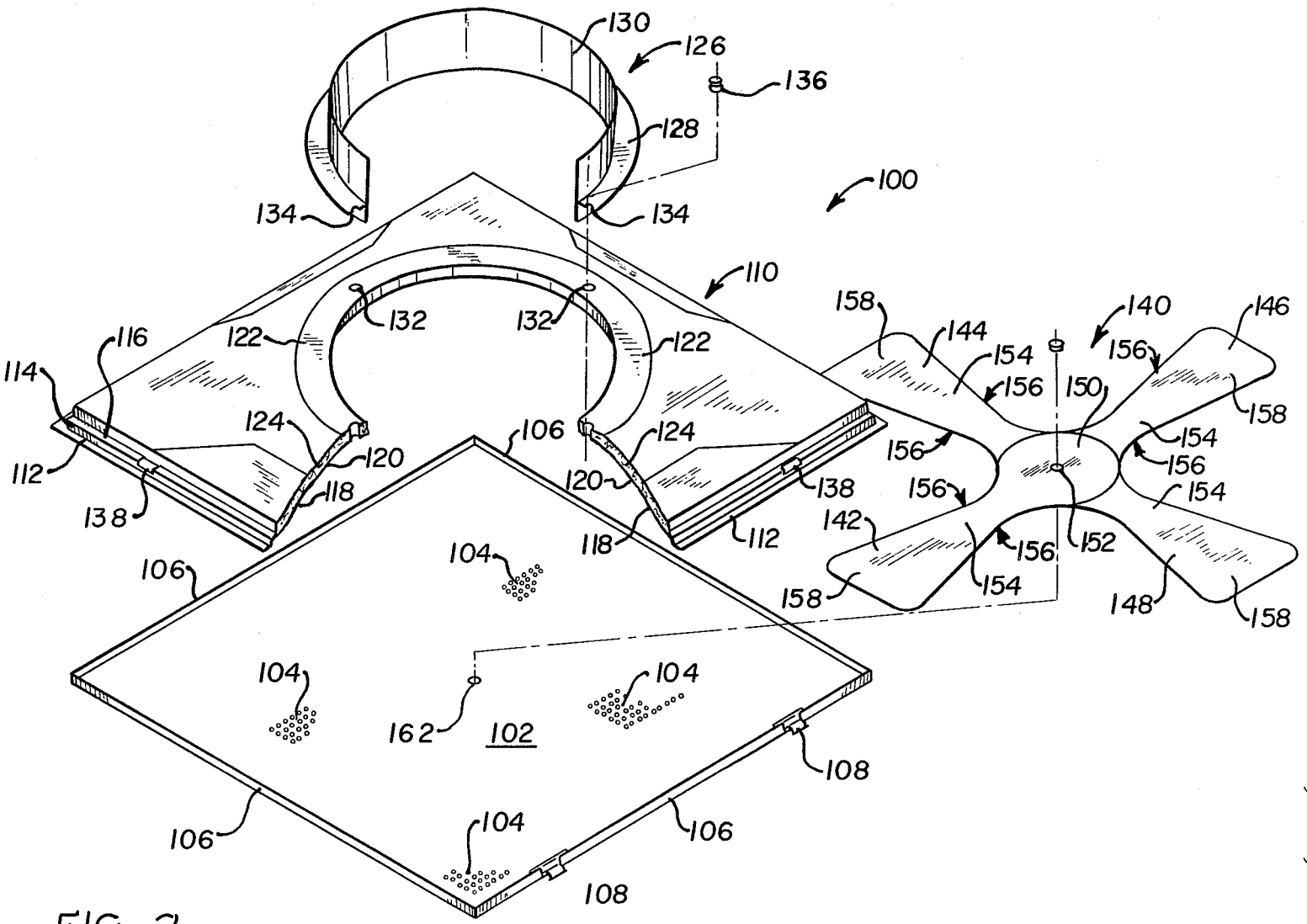
FIG. 2 is an exploded view of the embodiment of an air deflector arrangement in accordance with an invention as shown in FIG. 1.
Figure 3:
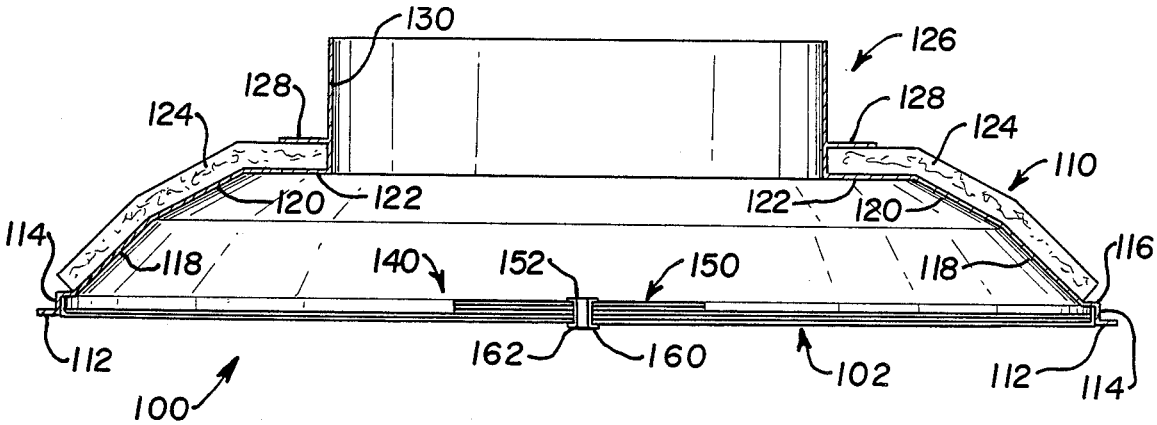
FIG. 3 is a cross-sectional view of the air deflector arrangement shown in FIG. 1, and taken along lines 3—3 of FIG. 1.

With specific reference to FIGS. 1–3 of the drawings, the air deflector arrangement 100 is adapted to be mounted in a conventional ceiling arrangement, such as a ceiling of well-known T-bar construction having a support frame with rectangular panels removably mounted thereon (not shown). However, the arrangement 100 is not limited to "ceiling-mounting" configurations. The arrangement 100 includes a planar face or screen 102 having a series of perforations 104 protruding therethrough. Although not specifically shown in the drawings, the perforations 104 would be located throughout the entire planar area of the face 102. The face 102 provides a suitable cover for the air deflector arrangement 100 with respect to safety and aesthetic characteristics. Preferably, the deflector arrangement 100 would be positioned within the ceiling so that the face 102 would be maintained substantially flush and coplanar with the conventional ceiling panels.

As also shown in FIGS. 1–3, the face or screen 102 includes a series of side wall portions 106 extending around the perimeter of the planar portion of the face 102 and perpendicularly disposed thereto. The face 102 can be constructed of any of a number of suitable materials, such as steel, aluminum or plastic. In addition, the face 102 is not necessarily limited to any type of "standard" perforated face material and, accordingly, materials such as expanded metal materials could be employed. Further, although the face 102 is shown in the drawings as being of a rectangular configuration, numerous other types of geometric configurations can be utilized.

As primarily shown in FIG. 2, secured to one of the four side wall portions 106 is a pair of hinges 108. The hinges 108 can be securely mounted to the corresponding side wall portion 106 by any suitable means, and extend substantially perpendicularly outward from the elongated dimension of the side wall portion 106. As described subsequently herein, the hinges 108 can be utilized for providing a pivotable hinging mechanism so as to allow the deflector arrangement 100 to be pivoted away or removed from its normal position on the ceiling for purposes of deflector blade adjustment.

Positioned rearwardly from the face or screen 102 is a back panel 110 having a somewhat frustum-shaped configuration. As shown in the drawings, the back panel 110 includes around its lowermost perimeter a laterally-extending lip portion 112 which can be of a suitable shape and size so as to provide a means for securing the air deflector arrangement 100 within a T-bar support frame, plaster, tile or other ceiling styles at a desired position. It should be emphasized that the arrangement 100 can be mounted to essentially any ceiling of any style having suitable adaptable margins. In addition, the arrangement 100 can also be duct-mounted in what is conventionally known as a "free-floating" arrangement. Although not shown in the drawings, the lip 112 can include bores or other suitable means which can be used in combination with screws or the like to rigidly secure the deflector arrangement to a ceiling support frame. Integral with and extending upwardly from the inner portion of the lip 112 is a side portion 114 also extending around the perimeter of the back panel 110. Extending inwardly from the uppermost area of the side portion 114 is a relatively small ledge portion 116. The ledge portion 116 is integral with a first angled portion 118 which, in turn, is integrally connected to a second angled portion 120 having a cross-sectional angle (FIG. 3) relative to the plane of the face 102 slightly less than the corresponding angle of the first angled portion 118. The second angled portion 120 flares downwardly toward the corners of back panel 110 and is integral with an annular flat portion 122. The annular flat portion 122 forms the uppermost circumferential edge of the back panel 110.

As best shown in FIG. 3, secured to the upper faces of the first angled portion 118, second angled portion 120 and annular flat portion 122 is an annular and somewhat frustum-shaped insulation segment 124. The insulation segment includes sections which correspondingly fit adjacent to the angled portions 118, 120 and annular flat portion 122. The insulation segment 124 provides a suitable insulation so as to avoid loss of heat or cooling air from the spatial area under environmental control. Preferably, the portions of the back panel 110 independent of the insulation segment 124 are constructed of a relatively thin metallic material. The insulation segment 124 can be of any suitable type of materials, such as a fiberglass material with an aluminum backing. Further, the insulation material can be secured to the upper faces of the back panel 110 by any suitable means, such as glue, epoxy or the like.

For purposes of hingedly securing the back panel 110 to the face or screen 102, the back panel 110 includes a series of slots 138 spaced around the perimeter on the side portions 114 and ledge portions 116. To pivotably secure the face or screen 102 to the back panel 110, the hinges 108 located on one side of the side wall portions 106 are received within the slots 138. Preferably, the hinges 108 are mounted to the face or screen 102 so as to be adjustable along the elongated dimension of one of the side wall portions 106. This adjustment allows for tolerances in the locations of the slots 138 of the back panel 110.

In one illustrative embodiment, the face or screen 102 can be shaped and sized so as to essentially be snap-fitted onto the back panel 110. To provide this snap-fitting arrangement, the size of the perimeter formed by the side portion 114 of the back panel 110, when the face or screen 102 is removed from the back panel 110, can be slightly less than the perimeter formed by the side wall portions 106 of face 102. In addition, the back panel 110 can be constructed so as to be slightly resilient in a manner so that the face 102 can be snugly fitted onto the back panel 110, with the side wall portions 106 of face 102 bearing against the side portion 114 of the back panel 110. The back panel 110 will then be in a slightly tensioned state, with the side portion 114 exerting forces against the side wall portions 106. To pivot the face 102 downwardly from the back panel 110, along one of the side wall portions 106, the face 102 can be manually grasped away from the side wall portion 106 mounting the hinges 108, and pulled downwardly. As the face 102 pivots downwardly, the hinges 108 will correspondingly be pivoted and engage the side portion 114 at the slots 138. In this manner, the hinges 108 will provide a hanging support of the face 102 from the back panel 110.

Alternatively to the snap fitting arrangement, it is also possible to provide, for example, two latches or similar mechanisms (not shown) on the sides of the face 102 and back panel 110 opposite to the side of face 102 which mounts the hinges 108. To pivot the face 102 away from the back panel 110, the latches or similar mechanisms would be disengaged and the face 102 would be pivoted as described above.

The foregoing describes one particular embodiment for removably or pivotably securing the face 102 to the back panel 110. Numerous other arrangements can be employed to secure the face 102 to the back panel 110. It is advantageous, however, to provide a means for manually lowering the face 102 from the back panel 110, whether through use of a pivot arrangement as described in the foregoing, or any other suitable means. The removal or pivoting of the face 102 from the back panel 110 facilitates maintenance of the deflector arrangement 100 and also provides a means for allowing manual adjustment of the deflector blades (to be described in subsequent paragraphs) from the inside of the arrangement 100. In addition, if a damper or the like (not shown) is mounted to the collar 130, access to the damper would also be provided by the foregoing means.

As further shown in FIGS. 1–3, the deflector arrangement 100 also includes a collar 126 having an annular flange 128. Extending perpendicular to the annular flange 128 is a cylindrical section 130 extending both upwardly and downwardly from the flange 128. For purposes of removably securing the collar 126 to the back panel 110, a series of apertures 132 extend through the insulation segment 124 and the annular flat portion 122 of the back panel 110. Correspondingly, the annular flange 128 of the collar 126 also includes a series of apertures 134 located around the perimeter of the collar 126 formed by the flange 128. The apertures 124 are located so as to be co-extensive with the apertures 132 of the back panel 110. In addition, the diameter of the cylinder formed by the cylindrical section 130 substantially corresponds to the diameter of the circular section formed by the innermost edge of the annular flat portion 122 and the insulation segment 124 of the back panel 110. Accordingly, the collar 126 is releasably "snap-fitted" onto the back panel 110 by positioning the collar 126 so that the lower face of the annular flange 128 is adjacent to the upper face of the annular flat portion 122 of back panel 110. With the apertures 132 positioned so as to be co-extensive with the apertures 134, snap-fittings 136 (one of which is shown in FIG. 2) or similar securing means can be received through the apertures 132, 134 so as to securely mount the collar 126 to the back panel 110.

The foregoing paragraphs describe a particular arrangement for a suitable collar 126, back panel 110 and face or screen 102 for an air deflector arrangement 100 in accordance with the invention. However, the general size, configuration and interconnection of these elements do not form the basis for any of the primary principles of an air deflector arrangement in accordance with the invention. That is, numerous other types of arrangements can be utilized to provide a protective and perforated face or screen, covering back panel and interconnected collar without departing from the novel concepts of the invention.

Referring again to FIGS. 1–3, the air deflector arrangement 100 further comprises a set of four deflector blades 140. For purposes of description, the deflector blades are identified as blades 142, 144, 146 and 148. Each of the deflector blades 140 is a separately constructed element from each of the other deflector blades 140 and comprises a central inner portion 150 having an aperture 152 extending therethrough. The deflector blades 140 are substantially of a flat and elongated configuration, and each of the central portions 150 is of a substantially disc-shaped circular configuration. Extending outwardly from one section of the central portion 150 of each of the blades 140 is an elongated middle portion 154 having a concave-shaped configuration along its two lateral edges 156. For purposes of description and clarification of an air deflector arrangement according to the invention, these elongated portions will be designated herein as waist portions 154.

Extending in a direction opposing the direction of the central portion 150 from the waist portions 154 are distal sections 158 which flare outwardly from the waist portions 154. As primarily shown in FIG. 2, the terminating ends of the distal portions 158 are substantially radiused. The radiusing of the terminating ends allows for selective rotation of the deflector blades 140 along the sides of the face 102 without interference.

Each of the deflector blades 140 is substantially identical in size and configuration to each of the other deflector blades 140. Any of various types of materials can be utilized for construction of the deflector blades 140. However, the material should be such that it provides relatively substantial rigidity and strength, notwithstanding construction in an elongated and relatively thin configuration. Preferably, the material utilized for deflector blade construction should be one of numerous and well-known non-combustible materials for use in fire-rated commercial facilities.

The deflector blades 140 are further constructed so that the central portions 150 can be fitted one on top of the other with the apertures 152 being coaxial. The four deflector blades 140 are rotatably secured at the center of the face or screen 102 by means of an eyelet fastener 160 or any suitable similar securing means, with the eyelet fastener 160 extending through the apertures 152 of the deflector blades 150 and through an aperture 162 extending through the face 102 at the center thereof. Again, although the illustrative embodiment of the deflector arrangement 100 in accordance with the invention as shown in FIGS. 1–3 includes an eyelet fastener 160, any suitable securing means can be employed to rotatably secure the blades 140 to the face or screen 102. For example, a rivot-type fastener could be employed. The eyelet fastener, however, is somewhat advantageous in that it provides a hole through which a damper handle (not shown) or similar device could pass through the face 102.

With the deflector blades 140 mounted to the face or screen 102, and with the face 102, back panel 110 and collar 126 interconnected as previously described, the air deflector arrangement 100 provides an advantageous arrangement for directional air flow in a manner so as to achieve separate, distinct and discrete air flow patterns in radial directions relative to the face 102 of the deflector arrangement 100. So as to provide what can be characterized as a theoretically infinite number of variations in the directional air flow patterns, each of the deflector blades 140 is freely rotatable throughout a 360° range of motion relative to each of the other deflector blades 140. In this manner, the deflector blades 140 can be arranged in any desired configuration relative to the other blades 140 so as to achieve the appropriate directional air flow pattern.

It has been found that the particular shape of the deflector blades 140, as primarily shown in FIG. 2, with a substantially circular central portion 150, concave-shaped waist portion 154 and outwardly flared distal portion 158 provides substantially definite and fully adjustable flow patterns over a full range of air delivery for varying sized collars. In particular, it has been found that the previously described deflector blade shapes provide definite and discrete air flow patterns for collar sizes which may vary in diameter from 6 inches to 14 inches. For collar sizes having such a significant variance, previously known air deflector designs could not employ a single design configuration for elements specifically utilized to deflect air flow so as to achieve a desired pattern.

Figure 4:
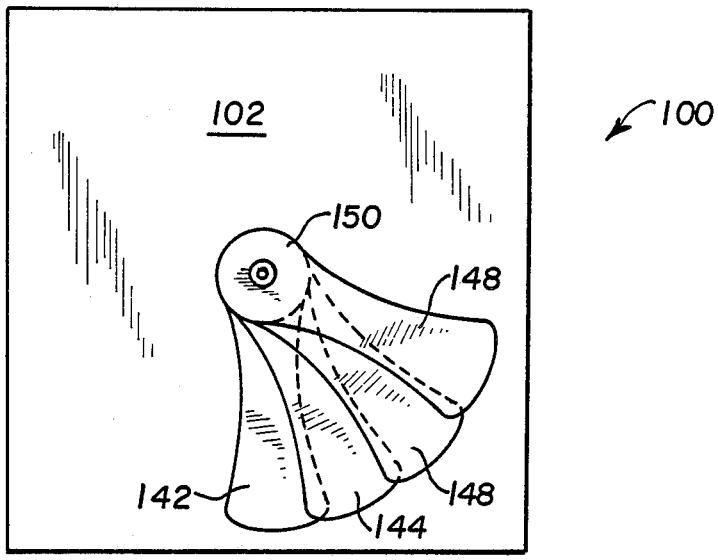
FIG. 4 is a diagramatic front view of the air deflector arrangement showing the deflector blades in one alternative configuration.
Figure 5:
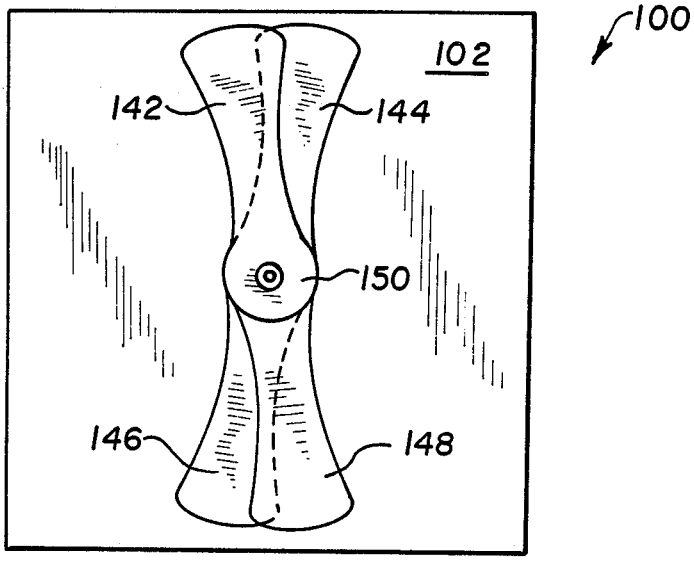
FIG. 5 is a diagramatic front view of the air deflector arrangement showing the deflector blades in a further alternative-configuration.
Figure 7:
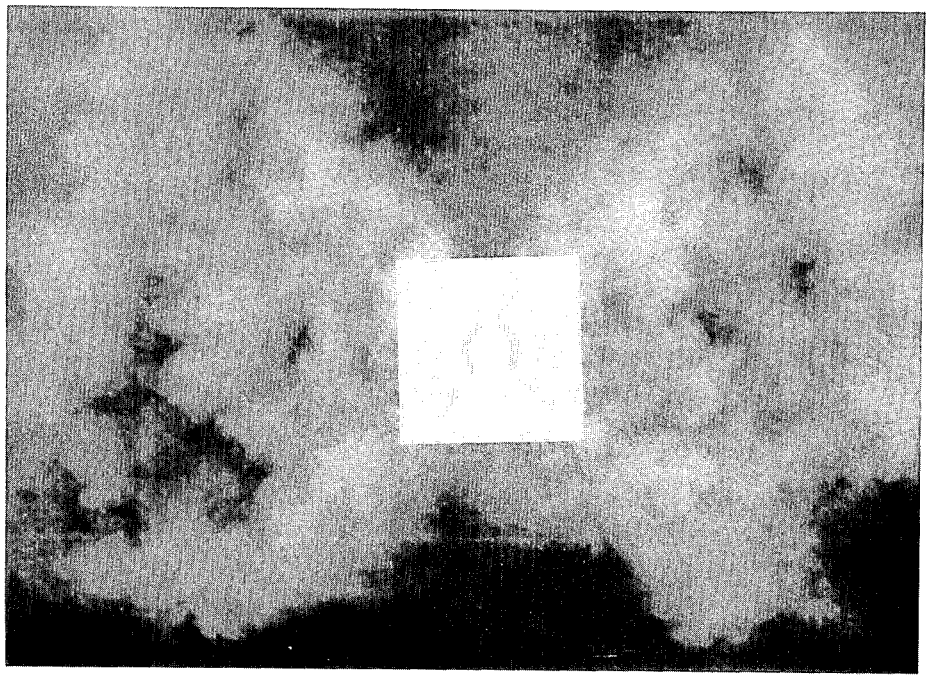
FIG. 7 is a photograph of an alternative "two-way" configuration of the deflector blades of the air deflector arrangement shown in FIG. 6, and showing the smoke test pattern produced thereby.

As previously described, rotation of the individual deflector blades 140 into differing relative configurations will provide differing air flow patterns in radial directions relative to the face 102. One such configuration is shown in FIG. 4, with the deflector blades substantially overlapping and positioned in a "two-way corner" configuration. Another arrangement of the deflector blades 140 is shown in FIG. 5, with blades 142 and 144 having a relative overlap, and with the deflector blades 146 and 148 having a relative overlap but diametrically opposed to the position of blades 142, 144.

It should also be emphasized that the deflector arrangement 100 in accordance with the invention, with the deflector blade configurations as shown in FIG. 2, not only achieves the capability of providing separate and discrete directional air flow patterns, but also correspondingly allows a substantial amount of "open area" toward the face 102. This open area is provided in substantial part by the concave shape of the two lateral edges 156 of the waist portions 154 of each deflector blade 140. By providing a substantial open area, arrangement of the deflector blades 140 in various relative configurations will not significantly reduce the air flow volume. Correspondingly, with the substantial portion of open area being provided, the deflector arrangement 100 does not cause the significant disadvantage of a buildup of static back pressure within the spacial area behind the face 102. Allowing and maintaining a substantial air volume, while correspondingly providing a variety of directional air flow patterns, is extremely advantageous in maintaining efficiency of operation of the heating, cooling or ventilation equipment generating the initial air flow.

An air deflector arrangement in accordance with the invention and substantially corresponding to the deflector arrangement 100 described herein has been reduced to practice and subjected to a series of tests. These tests included the arrangement of the deflector blades 140 in various configurations relative to one another. For purposes of determining the directional air flow patterns achieved by the deflector arrangement, detectable smoke was forced through the deflector arrangement.

Figure 6:
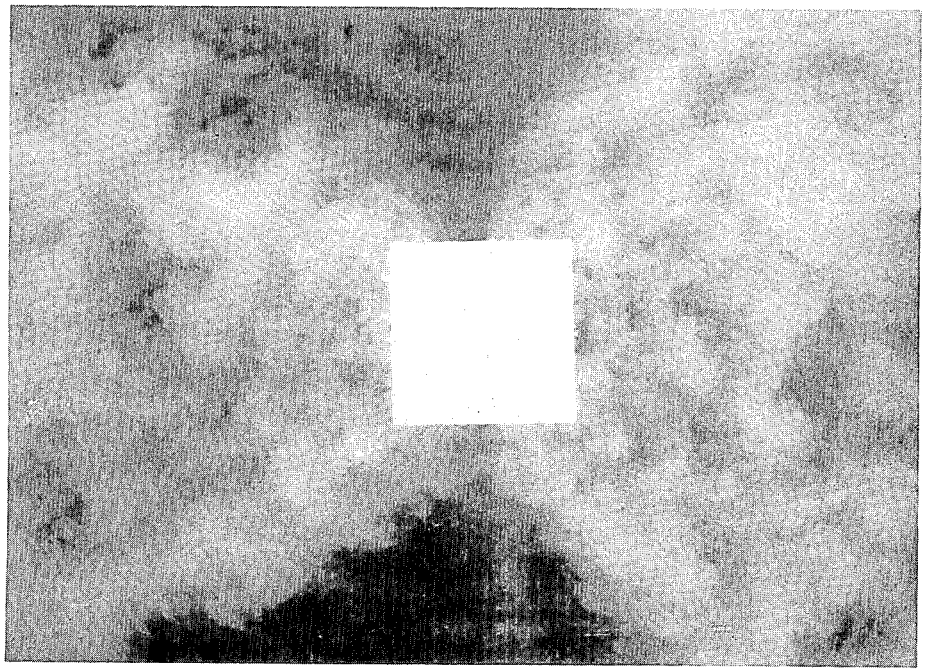
FIG. 6 is a photograph of an embodiment of an air deflector arrangement in accordance with the invention and reduced to practice, showing the deflector blades in a particular "two-way" configuration and the resultant air flow pattern (pursuant to a smoke test arrangement) produced thereby.
Figure 9:
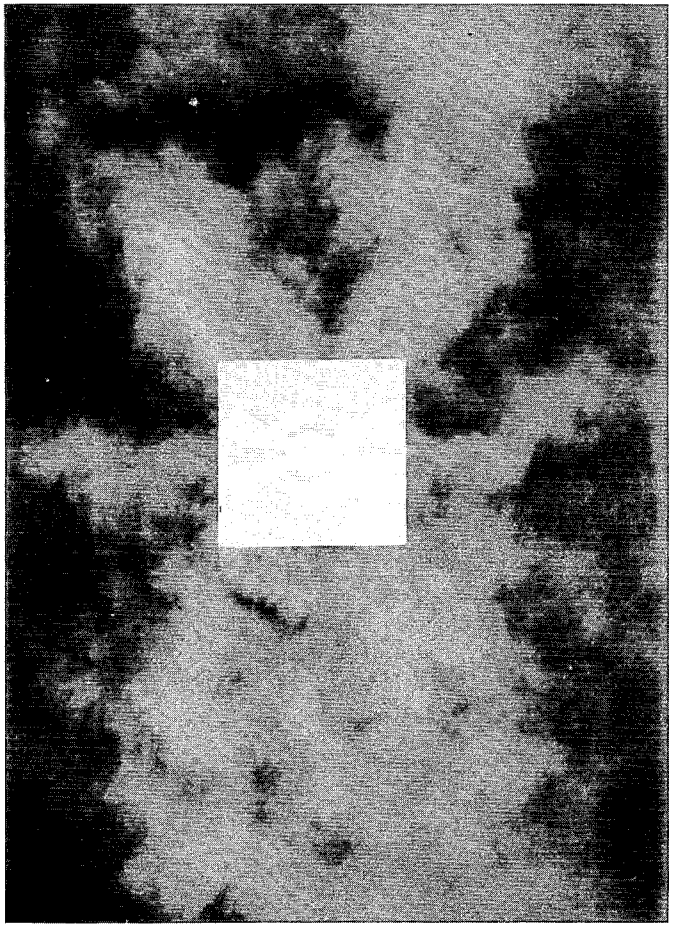
FIG. 9 is a photograph of another deflector blade configuration of the air deflector arrangement shown in FIG. 6, with the blades in a "two-way" configuration (but separated more than in FIG. 8), and showing the smoke test pattern produced thereby.
Figure 8:
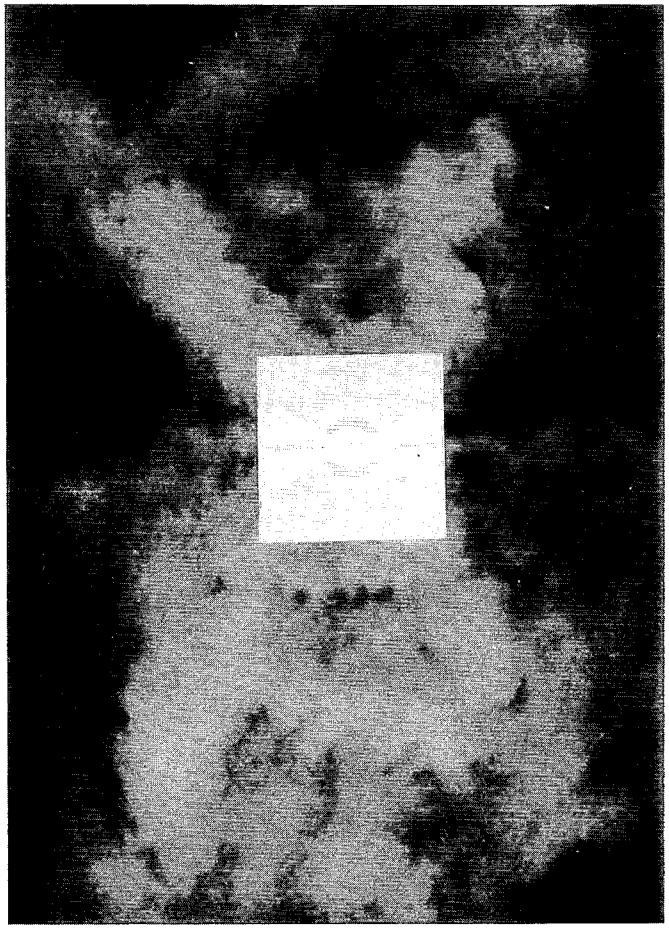
FIG. 8 is a photograph of another alternative deflector blade configuration of the air deflector arrangement shown in FIG. 6, with the blades in a "two-way" slightly separated configuration, and showing the smoke test pattern produced thereby.
Figure 11:
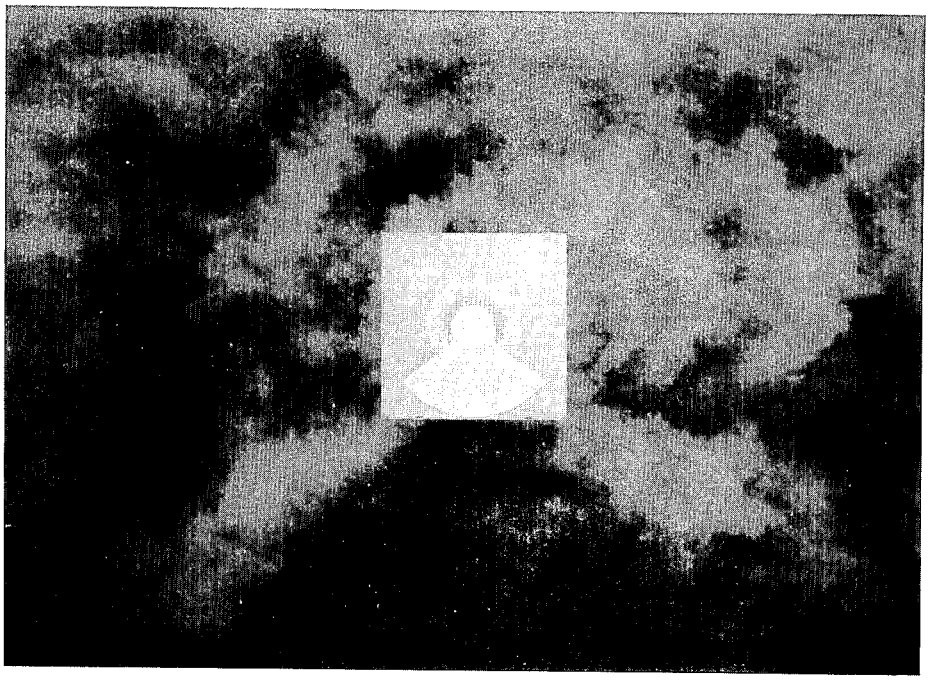
FIG. 11 is a photograph of a "three-way" alternative blade configuration of the air deflector arrangement shown in FIG. 6, and further showing the resultant smoke test pattern produced thereby.
Figure 10:
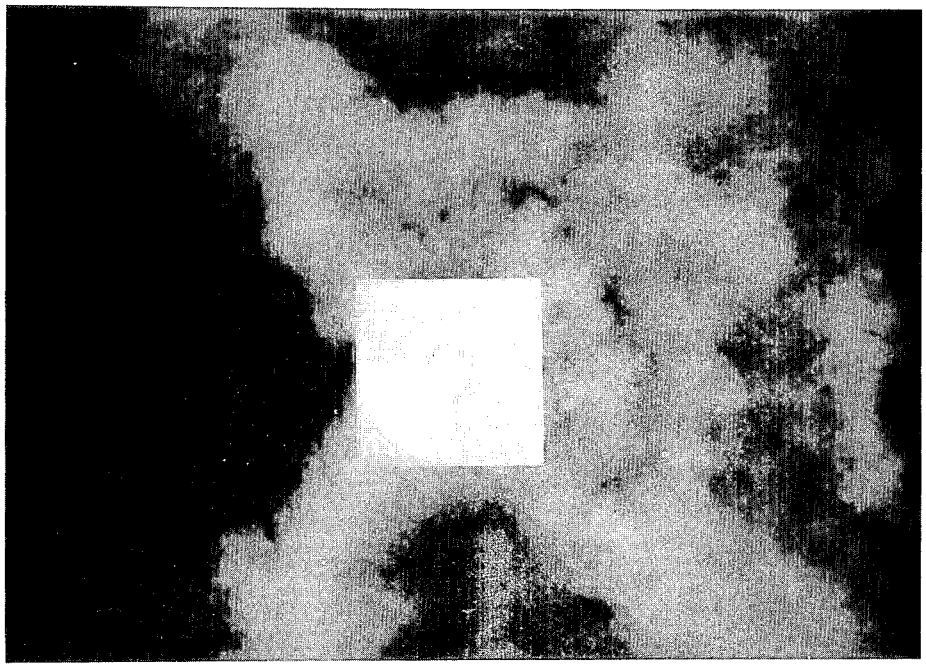
FIG. 10 is a photograph of a "two-way corner" alternative blade configuration of the air deflector arrangement shown in FIG. 6, and further showing the resultant smoke test pattern produced thereby.
Figure 13:
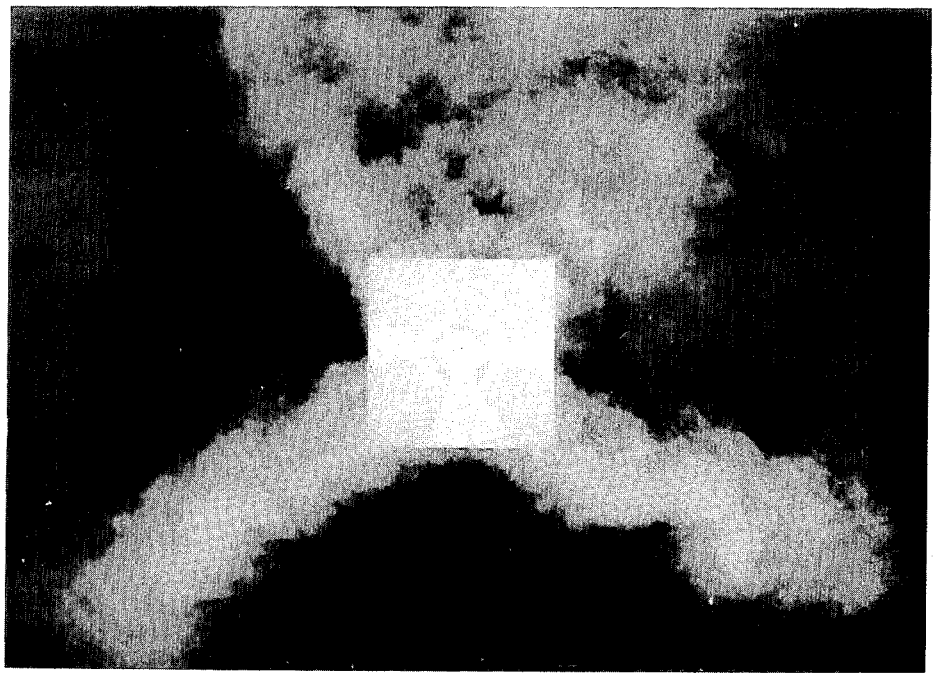
FIG. 13 is a further "three-way" alternative blade configuration of the air deflector arrangement shown in FIG. 6, and further showing the resultant smoke test pattern produced thereby.
Figure 12:
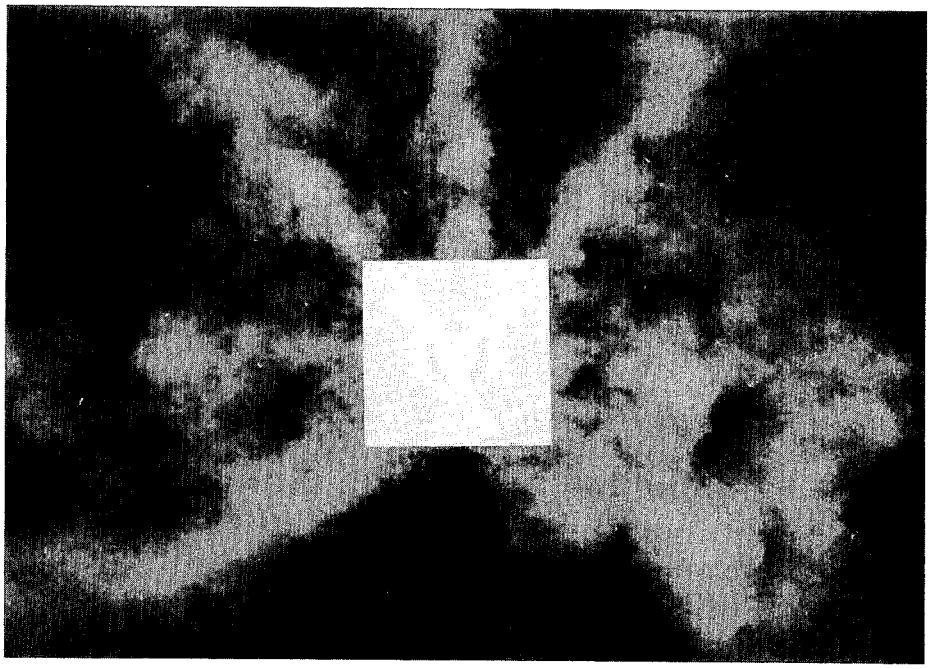
FIG. 12 is a photograph of another "three-way" alternative blade configuration of the air deflector arrangement shown in FIG. 6, and further showing the resultant smoke test pattern produced thereby.
Figure 15:
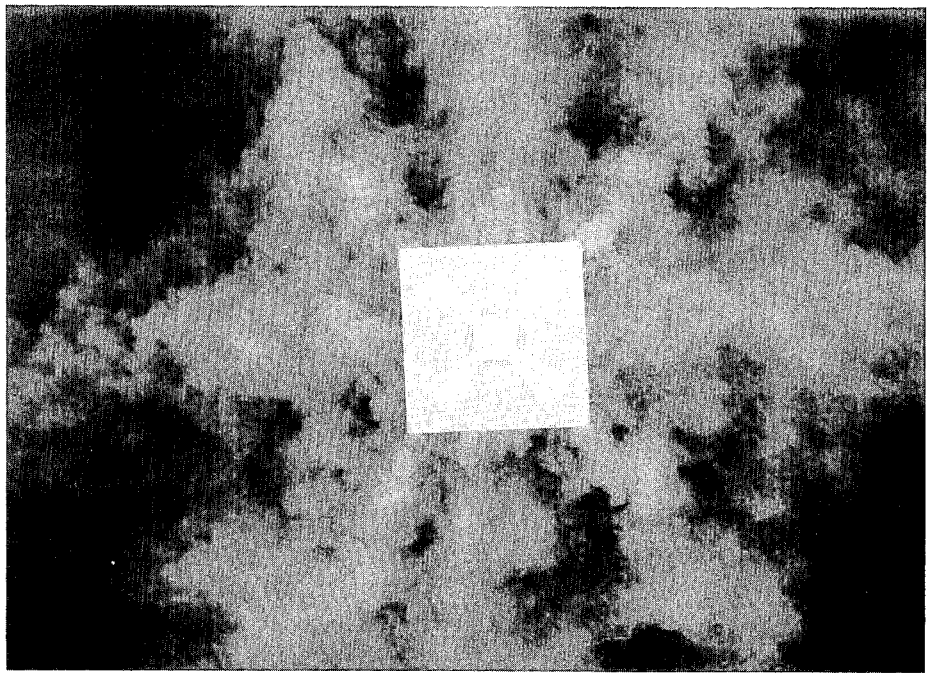
FIG. 15 is a photograph of a "360°" alternative blade configuration of the air deflector arrangement shown in FIG. 6, and further showing the resultant smoke test pattern produced thereby.
Figure 14:
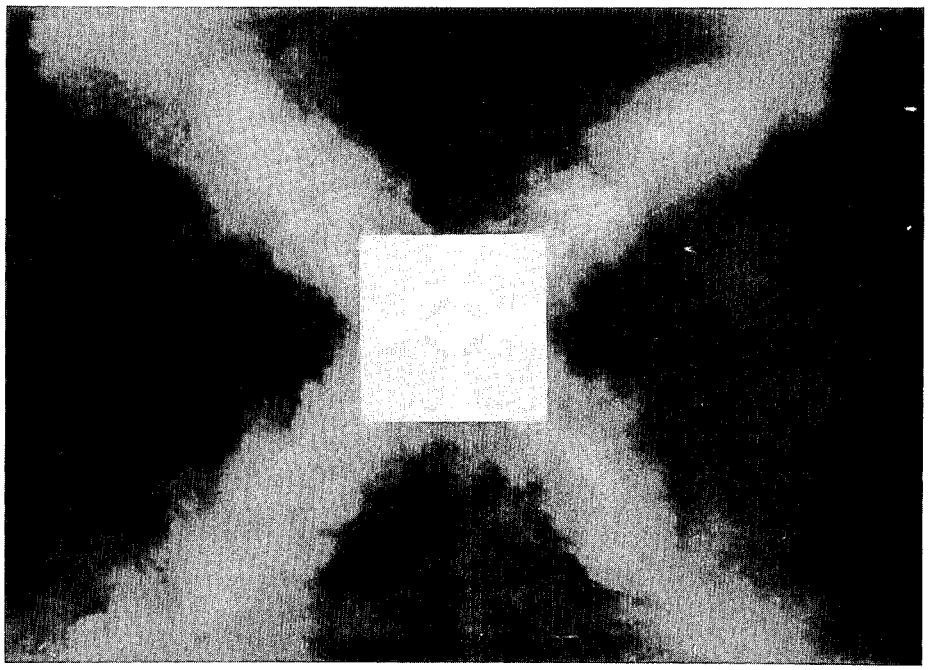
FIG. 14 is a photograph of a "four-way corner" alternative blade configuration of the air deflector arrangement shown in FIG. 6, and further showing the resultant smoke test pattern produced thereby.

FIGS. 6–15 illustrate the substantially advantageous results of the smoke pattern tests. For example, FIG. 6 depicts the deflector blades 140 in a "two-way" configuration substantially corresponding to the configuration shown in FIG. 5, and illustrates the relatively distinct directional air flow pattern provided by the two-way configuration. It should be noted again that a primary purpose of the deflector blades 140 is to achieve distinct air flow patterns in radial directions relative to the face 102 of the deflector arrangement. As another example, FIG. 8 depicts a two-way configuration of the deflector blades 140 but with the deflector blades 140 being somewhat separated so that none of the blades 140 overlap. FIG. 8 also illustrates the directional air flow pattern provided by the corresponding blade configuration. As described in the section entitled "Brief Description of the Drawings," the remaining drawings illustrate other types of alternative blade configurations with the corresponding directional air flow patterns produced thereby. Again, it should be emphasized that the particular shape of the deflector blades 140 appears of importance in achieving appropriate directional air flow patterns while maintaining substantial air volume through the deflector arrangement. Furthermore, it should also again be emphasized that the capability of rotation of each of the blades 140 throughout a full 360° range of motion relative to the other blades provides a theoretically infinite variety of directional air flow patterns.

It has also been found that optimum length of each of the deflector blades 140 is dependent upon the area of the face 102. For a typical air deflector having a 24 inch square face, it has been found that advantageous control of directional air flow patterns is achieved with a length of the deflector blades in the range of approximately 10 to 12 inches, measured from the central pivot point of the central portion 150 to the edge of the distal portion 158. For this size, the terminating end of the distal portion 158 will be within approximately 4 to 6 inches of the edges of the face 102. It is apparent from the foregoing that a face size such as a 12-inch square face would require a relative size reduction in the length of the deflector blades 140.

It has also been found that it is substantially advantageous to provide a diameter of the central portions 150 in the range of approximately 4 to 6 inches. With diameters of the central portions 150 being of a smaller size, it has been found that air "bypass" with relatively large collar sizes in the range of 12 inches and 14 inches increases to the extent that a discrete air flow pattern is not achieved. Correspondingly, it has also been found that substantially larger diameters of the central portions 150 becomes too restrictive of air flow volume with relatively smaller collar sizes, such as sizes in the range of 6 inches.

With the sizes of the blade lengths and central portions as described above, it has also been found that it is advantageous to provide a width of the waist portions 144 in the range of approximately 1 to 3 inches. This width has been shown to be a relative optimum width in that it is sufficient so as to prevent air "leakage" hen the deflector blades 140 are located in adjacent positions. Correspondingly, if the width of the waist portions 154 is increased, it was found that the directional air flow pattern degenerated relatively rapidly. Correspondingly, as the width of the waist portions 154 was increased, static back pressure within the deflector arrangement 100 also increased.

With respect to the maximum width of the distal portions 158, and with the sizes of the other portions of the deflector blades 140 as described above, it has been found that a width of approximately 4 to 6 inches provided requisite blockage and pattern control, whether the deflector blades 140 were positioned so as to be separated, or were otherwise positioned in a tandem arrangement so as to overlap. When the width of the distal portions 158 was decreased, the air flow pattern would tend to degenerate from a distinct entity to a generalized 360° diffusion. Correspondingly, when the width of the distal portions 158 was increased, and although the distinctness of the air flow patterns was not significantly altered, static back pressure within the deflector arrangement 100 would tend to undesirably increase. With respect to the distal portions 158, it should also be noted that it is advantageous to radius the terminating ends of the portions 158 for purposes of providing rotation of the blades 140 along the sides of the face 102 without interference with the face 102.

As earlier described, the air deflector arrangement 100 in accordance with the invention includes a hinge arrangement so as to allow the face 102 to be pivoted or otherwise removed from the back panel 110. In this manner, the deflector blades 140 can be manually altered in configuration. However, it is apparent from the foregoing that a slot and tab arrangement, or other suitable means could be included within the deflector arrangement 100 so as to allow manual manipulation of the deflector blades 140 without requiring opening of the face 102. Such an arrangement can be provided with an air deflector in accordance with the invention without departing from the novel concepts of the invention.

It should also be noted that it has been found that four deflector blades 140 appear to be an optimum number of blades for a deflector arrangement in accordance with the invention. If fewer than four deflector blades 140 are employed, the particular directional air flow patterns which can be achieved are limited. Use of more than four deflector blades 140 has been shown not to significantly increase the number of discrete directional air flow patterns which can be achieved, but will undesirably increase the static back pressure within the deflector arrangement 100. In addition, it is apparent that use of more than four deflector blades 140 will increase the cost and complexity of the deflector arrangement.

Although the deflector arrangement 100 is described herein as being adapted for use in a ceiling, such as a conventional T-bar and removable panel ceiling, it should be emphasized that a deflector arrangement in accordance with the invention can be used with other types of ceilings or in other areas of a space under environmental control. It should also be emphasized that with respect to the particular deflector blade dimensions as described herein to achieve optimal directional air flow patterns, such dimensions would increase or decrease proportionally to fit other sizes of faces 102.

In addition to the advantages of an air deflector arrangement in accordance with the invention as described above, it is also apparent that such a deflector arrangement is relatively simple in construction, thereby maintaining relatively low costs of manufacture and installation. As also described, the particular directional air flow patterns can be readily modified by merely modifying the angular positions of each of the deflector blades relative to each other. Furthermore, it should be noted that with the wide variety of directional air flow patterns which can be achieved with a deflector arrangement in accordance with the invention, the deflector arrangement can be utilized in various areas of an enclosed environment, such as centralized or corner areas of a ceiling. The directional air flow pattern through the air deflector arrangement can readily be modified by adjustment of the deflector blades so as to be suitable for the particular location of the deflector arrangement.

It will be apparent to those skilled in the pertinent art that other embodiments of air deflector arrangements in accordance with the invention can be designed. That is, the principles of an air deflector arrangement in accordance with the invention are not limited to this specific embodiment described herein. It will be apparent to those skilled in the art that modifications and other variations of the above-described illustrative embodiment of the invention may of the novel concepts of the invention.

The embodiment of the invention in which an exclusive property or privilege is claimed as defined as follows:

1. An air deflector arrangement adapted to be mounted in a ceiling or similar area for control of air flow patterns into an enclosed spatial area, said defector arrangement comprising:

face means for covering or otherwise separation an inner area of said deflector arrangement from said enclosed spatial area, while still allowing relatively free passage of air through said deflector arrangement into said spatial area;

housing means connectable to said face means and positioned rearwardly of said face means;

said housing means comprising an air passage for allowing air flow into said housing means and through said face means into said enclosed area; and blade means pivotably mounted within said inner area of said deflector arrangement, sand comprising a plurality of deflector blades centrally positioned rearward of said face means, with each of said deflector blades having an elongated configuration and freely rotatable throughout a 360° range of motion independent of angular locations of each of the others of said deflector blades.

2. An air deflector arrangement in accordance with claim 1 characterized in that each of said deflector blades is pivotably mounted within said inner area so as to form an axis of rotation coaxial with the axis of rotation of each of said other deflector blades.

3. An air deflector arrangement in accordance with claim 1 characterized in that each of said deflector blades is elongated in shape with a substantially planar configuration, and mounted so that the planar configuration is substantially parallel to the planar portion of said face means.

4. An air deflector arrangement in accordance with claim 1 characterized in that each of said deflector blades is elongated in shape and comprises a middle portion having concave-shaped lateral edges and a width narrower than the widths of other portions of said deflector blade.

5. An air deflector arrangement in accordance with claim 1 characterized in that each of said deflector blades comprises:

a central inner portion having a substantially disc-shaped circular configuration;

an elongated waist portion integral with said central portion and having concave-shaped lateral edges;

a distal portion integral with said waist portion and flaring outwardly relative to said waist portion; and the width of said waist portion is narrower than the diameter of said central portion and the width of said distal portion.

6. An air deflector arrangement in accordance with claim 5 characterized in that terminating ends of said distal portions are radiused so that free rotation of said deflector blades does not interfere with the sides of said face means.

7. An air deflector arrangement in accordance with claim 5 characterized in that each of said deflector blades is pivotably mounted within said inner area so that an axis of rotation for each of said blades is substantially centrally located relative to a planar portion of said face means, and extends through a center of said central inner portion.

8. An air deflector arrangement in accordance with claim 7 characterized in that said axis of rotation for each of said deflector blades is coaxial with the axis of rotation of each of said other deflector blades.

9. An air deflector arrangement in accordance with claim 8 characterized in that said planar portion of said face means is of a rectangular configuration having four sides each of approximately 24 inches in length, and the perpendicular distance between said axes of rotation and said terminating ends of said distal portions is in the range of approximately 10 to 12 inches.

10. An air deflector arrangement in accordance with claim 8 characterized in that the diameter of each of said central portions of said deflector blades is in the range of approximately 4 to 6 inches.

11. An air deflector arrangement in accordance with claim 10 characterized in that the width of each of said waist portions is in the range of approximately 1 to 3 inches at its minimum value between said concave-shaped lateral edges.

12. An air deflector arrangement in accordance with claim 11 characterized in that the width of each of said distal portions at its terminating ends is in the range of approximately 4 to 6 inches.

13. An air deflector arrangement in accordance with claim 1 characterized in that the number of deflector blades is at least four.

14. An air deflector arrangement in accordance with claim 1 characterized in that the number of deflector blades is four.

15. An air deflector arrangement in accordance with claim 1 characterized in that said arrangement further comprises means located at the approximate center of a planar portion of said face means for pivotably mounting each of said deflector blades.

16. An air deflector arrangement in accordance with claim 1 characterized in that said arrangement further comprises means for releasably securing said face means to said housing means so that said face means can be opened for manual adjustment of the angular positions of said deflector blades.

17. An air deflector arrangement in accordance with claim 1 characterized in that said arrangement further comprises a collar mounted to said housing means and surrounding said air passage.

18. An air deflector arrangement adapted to be mounted in a ceiling or similar area for directional control of air flow patterns into an enclosed spatial area in radial directions relative to said arrangement, the deflector arrangement comprising:

housing means for at least partially enclosing elements of said deflector arrangement;

a series of at least four deflector blades with each of said blades having a substantially elongated and flat configuration;

means for pivotably mounting said deflector blades to said deflector arrangement so that an axis of rotation of each deflector blade is coaxial with the axis of rotation of each of the others of said deflector blades; and each of said deflector blades is pivotably mounted so as to be freely rotatable throughout a 360° range of motion independent of angular positions of each of the others of said deflector blades.

19. An air deflector arrangement in accordance with claim 18 characterized in that said arrangement further comprises an air passage extending through a central portion of said housing means, and said deflector blades are each of a shape and-size so that relative rotation of each of said deflector blades into various configurations provides various discrete and definite patterns of air flow from said air passage in radial directions in said enclosed area relative to said deflector arrangement.

20. An air deflector arrangement in accordance with claim 18 characterized in that said deflector arrangement further comprises a perforated face or screen secured to the front of said housing means, and said deflector blades are each pivotably mounted to said perforated face or screen.

21. An air deflector arrangement in accordance with claim 18 characterized in that each of said deflector blades comprises: a central inner portion having a substantially disc-shaped circular configuration, with an axis of rotation of said deflector blade extending through a midpoint of said central inner portion;

an elongated waist portion integral with said central portion and having concave-shaped laterai edges;

a distal portion integral with said waist portion and flaring outwardly relative to said waist portion; and the width of said waist portion is narrower than the diameter of said central portion and the width of said distal portion.

22. An air deflector arrangement in accordance with claim 20 characterized in that said perforated face or screen is hingedly mounted to said housing means.

* * * * *